United States Patent [19]

Hahn et al.

[11] Patent Number: 4,951,555

[45] Date of Patent: Aug. 28, 1990

[54] SHOW CASE FOR KEEPING AND EXHIBITING OBJECTS

[75] Inventors: Till H. Hahn, Frankfurt am Main; Klaus Seidel, Hanover; Klaus Fischer, Niederdorfelden, all of Fed. Rep. of Germany

[73] Assignee: Glasbau Hahn GmbH & Co., KG, Frankfurt am Main, Fed. Rep. of Germany

[21] Appl. No.: 312,739

[22] Filed: Feb. 17, 1989

[30] Foreign Application Priority Data

Feb. 19, 1988 [DE] Fed. Rep. of Germany ..... 3805212

[51] Int. Cl.[5] ..... B08B 15/02

[52] U.S. Cl. ..... 98/1.5; 98/115.3; 55/385.4; 312/31.1; 312/114

[58] Field of Search ..... 98/1.5, 115.3; 55/385.1, 385.4, 310; 312/31.1, 114, 223, 236

[56] References Cited

U.S. PATENT DOCUMENTS

| | | | |
|---|---|---|---|
| 2,639,958 | 5/1953 | Stephenson | 312/114 X |
| 3,545,832 | 12/1970 | Levenback | 312/114 |
| 4,315,579 | 2/1982 | Martin, Jr. | 55/385.4 X |
| 4,660,464 | 4/1987 | Tanaka | 55/385.2 X |
| 4,668,484 | 5/1987 | Elliott | 312/31.1 X |
| 4,749,241 | 6/1988 | Thoresen et al. | 312/114 |
| 4,804,392 | 2/1989 | Spengler | 55/385.2 X |

FOREIGN PATENT DOCUMENTS

| | | | |
|---|---|---|---|
| 2459637 | 1/1981 | France | 312/31.1 |

*Primary Examiner*—Harold Joyce

*Attorney, Agent, or Firm*—Bucknam and Archer

[57] ABSTRACT

Show case (1) for keeping and exhibiting objects, the sides (4), the bottom (3) and the cover construction (2) of which encompass the interior of the show case more or less hermetically, wherein filter means (7) comprising preferably dust and/or gas protection filters and being accommodated in an air vent (5) clean air flowing into or being directed into said show case. When air flows in automatically due to changed pressure and temperature conditions inside and outside the show case, the show case is vented preferably through an air vent (6, 9) formed as an outlet valve. When it is impossible to seal the show case sufficiently, it will be ventilated forcibly with the least possible quantity of air by means of a pump or ventilating device connected to the interior of the show case through the filter means, which quantity of air is adapted to the air volumes flowing automatically into the show case when the air pressure increases suddenly or the temperature varies.

10 Claims, 5 Drawing Sheets

SHOW CASE FOR KEEPING AND EXHIBITING OBJECTS

BACKGROUND OF THE INVENTION

The invention relates to show cases for keeping and for exhibiting objects, the sides, the bottom and the cover construction of which encompass the interior of the show case more or less hermetically in order to protect said objects against dust and environmental loads of all kind. No matter how good and nearly perfect a show case may be sealed, it must be expected in practice that, due to variations of air pressure and temperature in the show case and in its ambient atmosphere, air and also dust reach the interior of the show case. Especially in case of air pressure variations occurring when high and low barometric pressure conditions alternate, each show case "inhales" up to 1/10th of its volume.

In order to protect the objects in show cases against ambient temperature variations or in order to maintain a predetermined temperature inside the show cases, it is general practice to provide show cases with an air conditioning system. However, such equipment is, on the one hand, very expensive and pays only for very expensive exhibits, and, on the other hand, they do not prevent harmful gases from entering the interior of the show cases together with air and from attacking the exhibits. Furthermore, it has turned out that strong air flows depending on the system may affect some objects detrimentally. Moreover, show cases connected to such air conditioning systems must be stationarily installed - usually along walls. Also such air conditioning systems can cause great damage in case of malfunction.

SUMMARY OF THE INVENTION

It is the object of the invention to provide show cases in which the objects accommodated therein are protected against environmental influences with the least possible technical expenditure and cost.

It is another object of the invention to provide a show case which is in a condition to be retrofitted and need not be stationary.

According to one object of the present invention, care is taken that the ventilation of the show case is effected at any rate through filter means. The simplest solution of such a ventilation is the air supply through said filter means occurring automatically due to increase of pressure; said filter means have the effect that the air does no longer enter the show case through seals but through the filter whereby it is cleaned. When the pressure in the vicinity of the show case decreases or, for example, when the temperature increases in the show case when the illumination is turned on, the show case delivers cleaned air again outwards from the interior of the show case. The necessary installations for such a "self-breathing" show case are very cost-saving and easy to install. It is possible to provide the bottom of the show case for example with air inlet tubes and air vents, the air inlet tubes being provided with a filter unit with an air inlet valve in front thereof and the air vents with a vent valve.

When the sealing of a show case is rather insufficient and the show case cannot be sealed sufficiently enough to guarantee that the entrance of air does not take place except through the filter, the show case is subjected to a forced ventilation — again through filter means. For this forced ventilation a source is used containing the air in compressed state or the air is compressed or ventilated before being supplied to the show case. A pump or fan used is therefore preset in such a way that it maintains the interior of the show case at a small pressure in small excess of the atmospheric pressure of the environment and supplies only very small air volumes which correspond to those air volumes "breathed" by the show case not provided with said pump or fan means in case the atmospheric pressure decreases or increases rapidly. Hence, the source supplies only the least quantity of air which is necessary to supply sufficient volumes of cleaned air also when temperature variations are very high so that unpurified air is prevented from entering through holes or insufficient sealings of the show case. Also in case of large show cases a simple, low-priced and quite small pump or fan is sufficient so that the installation expenses as well as the operating expenses are very low.

Due to the low rate of air flow in the self-breathing case as well as in show cases with forced ventilation it is seldom necessary to exchange the filters. It is advisable to use standard filters to be screwed on, such as common filter elements for gas masks, which can quickly and easily be screwed on vent tubes provided in one of the sides of the case.

According to another object of the invention, a pressure sensor and a control unit are used for activating the pump and a ventilator, respectively, only when the external pressure increases so that the contamination of the filter in a show case with forced ventilation is further reduced in favour of its working life.

According to another object of the invention a show case with forced ventilation and extremely low flow rate is provided with a low-priced air conditioning and control of air humidity of the interior of the show case by connecting the pump to a refrigerator or to a refrigerator provided with a hygrostat. In this way it is possible to clean, to dry and to control the humidity of individual show cases in a simple manner and at a reasonable price without connecting them to expensive air conditioning systems.

According to a further object of the invention, a pressure monitor means is connected to a show case with forced ventilation and the delivery of the pump is controlled and adjusted by a corresponding control line. Moreover, it is possible to indicate a failure of the pump as well as unallowed penetration into the show case which also causes a sudden pressure drop.

BRIEF DESCRIPTION OF THE DRAWINGS

In the accompanying drawings

DESCRIPTION OF PREFERRED EMBODIMENTS

Figure 1:
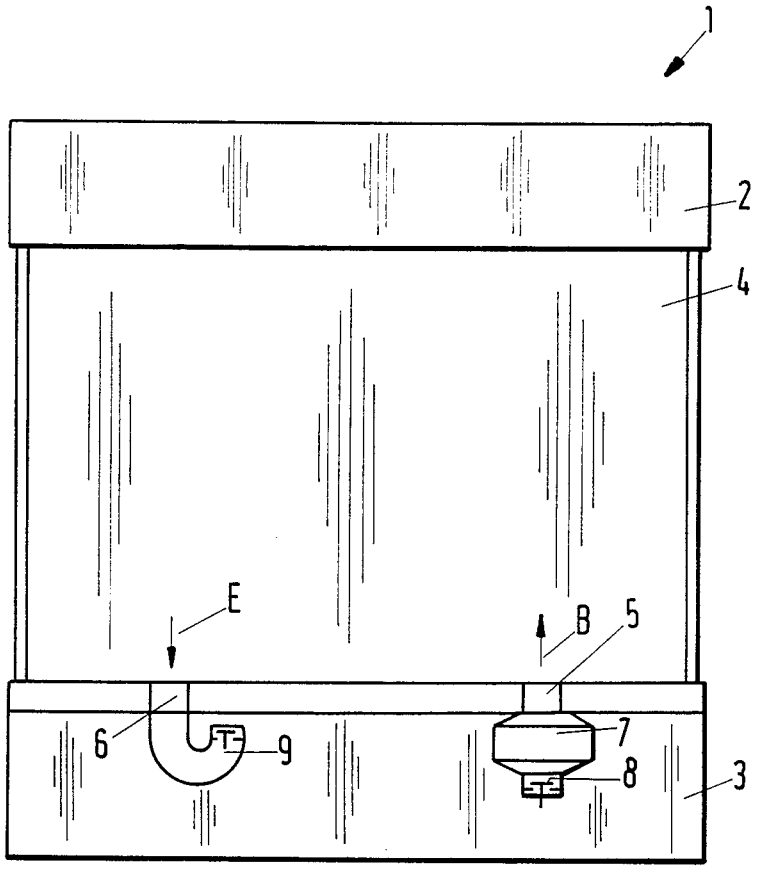
FIG. 1 illustrates schematically an embodiment of the show case according to the invention in the form of a self-breathing show case.

The longitudinal section of the self-breathing show case 1 in FIG. 1 comprises illumination box 2 preferably of aluminum, base 3 of the show case preferably of aluminum and/or steel and transparent show case body 4 of glass preferably float glass. A different transparent material, for example plastics material is possible, too. The case is provided with air inlet and outlet vents (B and E, respectively). The interior of the show case is substantially sealed for example by means of plastic profiles for sealing the joints of the glass panes of the case body 4, this illumination box 2 and base 3. In the embodiment a glass cement (SH 10) and silicone were used to glue and seal the joining edges. It is also possible to use neoprene instead of silicone. At any rate, advantageous materials having the same thermal coefficient of expansion are used for the show case body 4.

In the bottom of the show case body 4 air vents 5 and 6 are provided, the inlet air vent 5 being provided inside with a dust filter and/or gas protection filter 7 for chemical defense as well as with an inlet membrane valve 8, the U-shaped air vent 6 for air release is provided with a corresponding outlet membrane valve 9. As the air supply and release are separately provided, the filter is preserved as far as possible so that its working life is lengthened. The membrane valves 8 and 9 are preferably membrane valves of the kind used for respirators.

The air vent 5 is shaped and provided with a threaded tube or plug connection means that commercially available reasonably priced standard combination filters can be screwed on or attached on the vent piece made of metal or plastics material and the filter can be exchanged quickly and without problems. A suitable combination filter is the dust and gas protection filter, "Dräger-Kombinationsfilter 620 ST A2B2E2K2-P3".

In case of air pressure, variations in the environment and also of ambient temperature variations depending thereon either a corresponding quantity of cleaned air is supplied into the interior of the show case through the filter or a corresponding amount of air leaves the show case through the air vent 6. A show case sealed with plastic profiles "inhales" about 1/10 of its volume in case of barometric changes from high pressure to low pressure conditions and about 1/273 of its volume in case of DV temperature drop of one Kelvin. Even if the show case is very well sealed, an air circulation of about 50 % of the total volume must be expected per month so that the measure of filtering eliminating dust and harmful substances such as hydrogen sulphide has a great effect preventing exhibited objects from becoming covered with dust and from tarnishing for many years. Changing the filters becomes necessary only about every one or two years due to the low filter throughput so that the cost for cleaning the air (about DM 10 to 50 per filter) and maintenance service are very low. Also the expenditure of work as well as the cost for installation of the vent means as shown are low.

The installation and the type of the filter are, on the other hand, substantially at will. A filter may, for instance, also be provided on the upper side of the show case. Another possibility is not to provide a vent for air release because air may escape through the sealings which are never hermetical.

Figure 2:
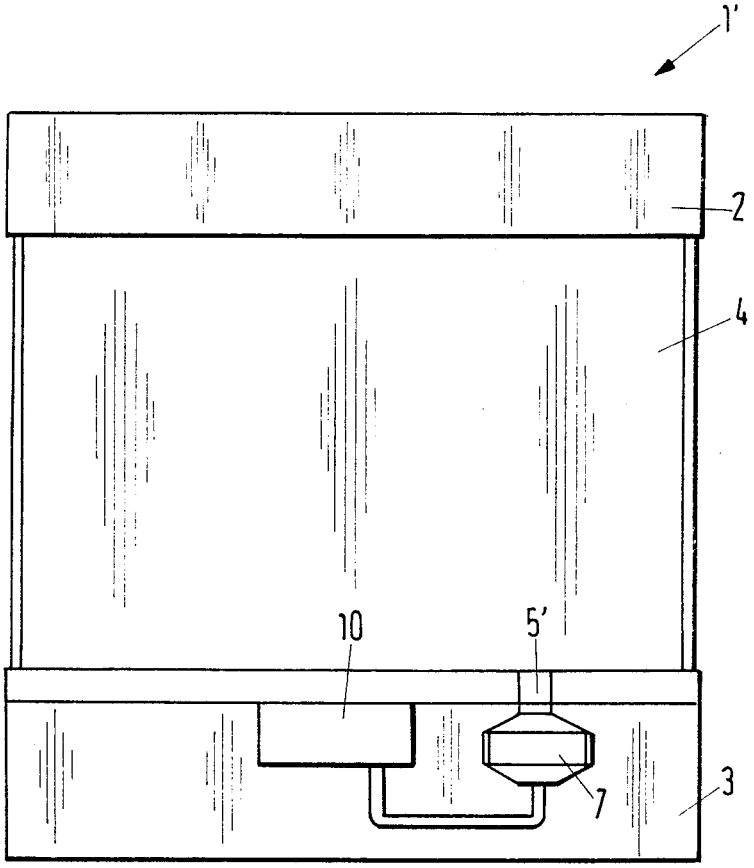
FIG. 2 is a schematic illustration of an embodiment of the show case according to the invention with forced ventilation.

The show case 1' with forced ventilation illustrated in FIG. 2 and comprising base 3, transparent show case body 4 and illumination box 2 is provided with a ventilation pump 10 accommodated below the bottom plate of the show case body 4 and extending into the base 3 of the show case. This pump is a low-priced aquarium pump of low output and is connected to an air vent 5' through a corresponding air conduit in the form of an air tube and pumps through said air vent 5' including a gas/dust protection filter 7 cleaned air into the show case.

Such a forced ventilation is suited particularly for show case bodies which can be sealed only very insufficiently or with difficulty. The pump requires only a very low delivery output which is adjusted preferably to the volume per time unit which would otherwise flow automatically into the show case in case the air pressure rises quickly. With a supposed maximal rise of air pressure of about 7 hpa this would correspond with about 7 liters per hour for a show case having an air volume of about 1000 l. A supply volume of about 10 l per hour would therefore be sufficient and is possible with standard aquarium pumps or any kind of membrane pump.

Inside the show case always a minor excess pressure compared to the atmospheric pressure of the environment is produced by the pump so that dust and harmful gases are prevented from entering the interior of the show case through slots or leaks and the air is supplied exclusively through the filter. On the other hand, evaporations of the lining and of the decoration means of the interior of the show case impairing the climate in the show case can be delivered outwards through slots or leaks in the sealing due to the low excess pressure.

The pump 10 can be connected electrically to the same connection cable as the other installations of the show case, i.e. for example its illumination device. Different from the illustrated solution it is also possible to accommodate the pump in the illumination box or on the rear side of a not self-supporting show case. The pump may also be accommodated outside the show case and connected thereto only by an air hose. Due to the minor delivery output of the pump it is possible to ventilate by force a plurality of show cases with a single pump.

Instead of the air pump a fan can be used, or a reservoir containing purified air or a neutral gas like argon or nitrogen under high pressure can be connected to the interior of the show case by means of a pressure reducing valve and/or mixing valve. It is also advantageous to use gaseous additions with conserving effects or effecting some kind of pest control.

Figure 3:
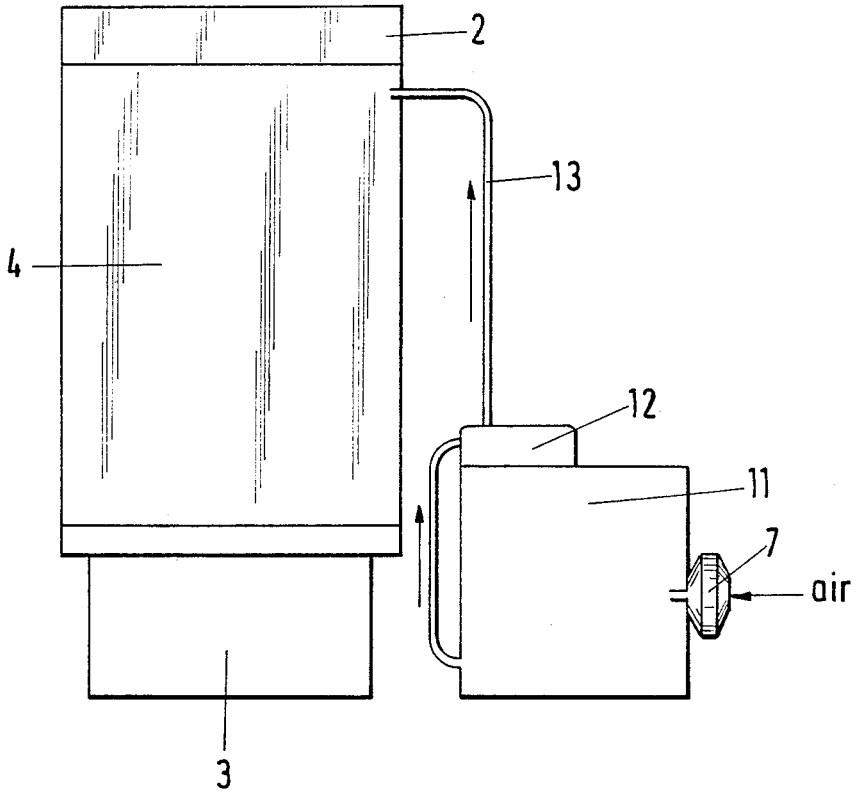
FIG. 3 illustrates the embodiment with a controlled dry climate in the show case.

The show case with forced ventilation according to the invention can be developed with advantage to a show case with a climate that can be controlled or with a dry climate. In order to produce an especially "dry" climate in the show case retarding the chemical reactions with metal objects, as shown in FIG. 3 the show case is sealed as well as possible by means of plastic profiles and adhesives (not shown) between the edges of the glass panes. A refrigerator 11 is placed outside the show case and air is supplied to the refrigerator through a filter 7 provided in the air supply of the refrigerator. The cooled "dried" air of about −20° C. is directed into the body 4 of the show case by means of a pump 12 and corresponding air conduits 13. When the air is heated again to room temperature, its relative humidity is extremely low (under 5 %) so that time-consuming preserving works to special moisture-sensitive exhibition objects are entirely unnecessary. The air may be filtered also in said further development with air drying behind the pump by means of a filter in the base of the show case. The pump and the refrigerator must produce, at any rate, only very low output and cooling power, respectively. The cooling power of a common refrigerator is much higher than the very small amount of supplied air of several liters per hour.

Figure 4:
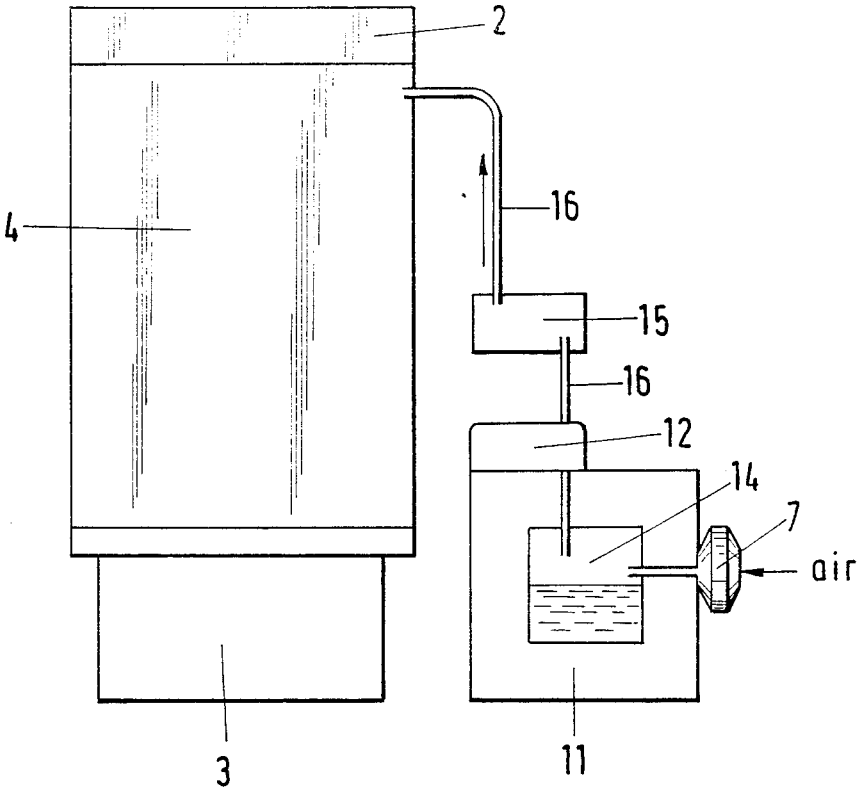
FIG. 4 illustrates the embodiment with a controlled constant air humidity in the show case.

When exhibits require a predetermined constant air humidity, the show case according to the invention with forced ventilation can be developed to a show case with controlled air humidity by means of a hygrostat and of a refrigerator as shown in FIG. 4. For this purpose, cleaned air is supplied to a refrigerator 11 through a laterally mounted gas protection and dust protection filter 7 and guided through a container 14 filled with water which is placed within the refrigerator. By means of a small aquarium pump 12 connected to the refrigerator cleaned air is again supplied by means of flexible tubes **1*b* first to the hygrostat 15** and then to the inside of the show case. The hygrostat is accommodated in a small measuring case comprising air with a humidity corresponding with that inside the show case. The small measuring case may be mounted to an outside wall of the show case or on the housing of the refrigerator of the pump. A control line not shown extends between the hygrostat and the refrigerator. When the air humidity is too high the hygrostat turns on the refrigerator, when it is too low the hygrostat turns the refrigerator off. Also for this development of the show case according to the invention with forced ventilation the installation cost as well as the operating cost are extremely low because of the poor flow of air. The pumping and cooling powers are again very low.

Figure 5:
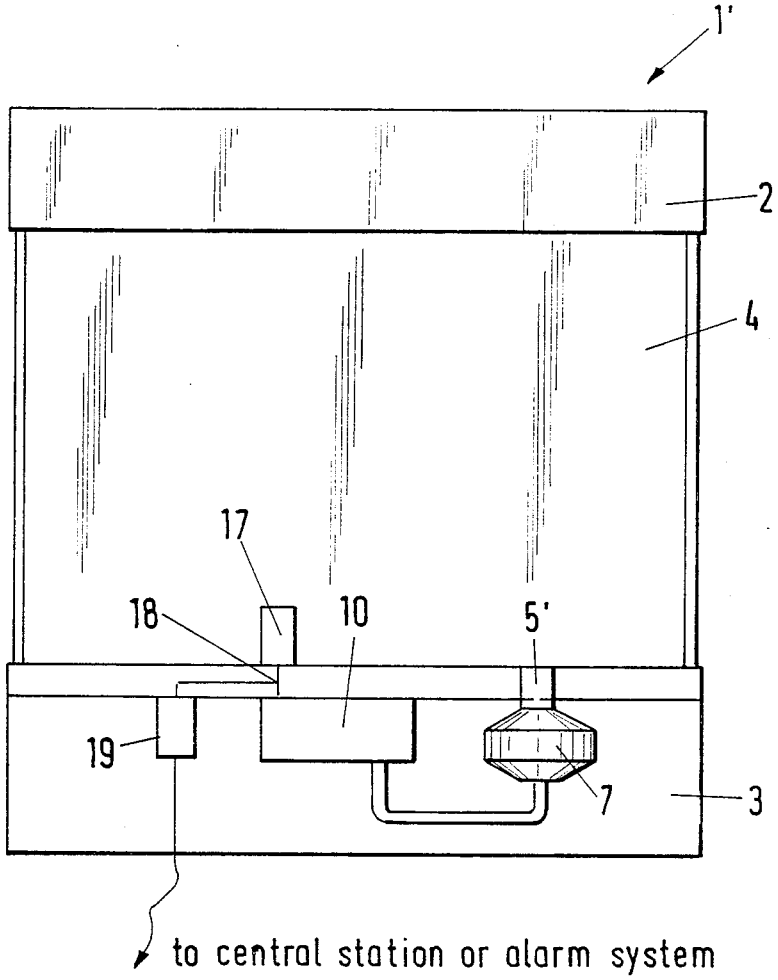
FIG. 5 illustrates the embodiment with a pressure control device.

A pressure monitoring and control device in the form of a pressure sensor giving a signal upon a sudden pressure drop can be connected to the show case 1' as shown in FIG. 5 to detect a failure of the pump for a show case with forced ventilation with or without climate control. The pump 10 keeps the internal pressure in the show case at an increased level so that the pressure control device responds reliably upon a pressure drop. Preferably, the pressure control device which comprises a pressure sensor 17 inside the show case 14 controls the delivery of the pump through a control line 18 connected to said pump so that always a predetermined air pressure is maintained inside the show case. Resistance manometers or manometer capsules can be used as pressure sensors, for example. A pressure drop below a predetermined value is detected by the pressure control device by comparison means 19 and supplied through switching means (not shown) connected to said device to produce a visible or audible signal in a central station through a corresponding line thereto when the pump breaks down. Moreover, it is advantageous that a signal is produced upon an unallowed opening of the show case which also results in a sudden pressure drop so that expensive other monitoring systems are not required and it is sufficient to connect an alarm line (not shown) or system to the said switching means to signal an unauthorized entry into the case.

Besides the possibility of controlling the air pressure inside the show case, the external pressure can also be controlled by means of a pressure sensor. The measured result is fed to a control device connected to the pump or a ventilating device or also to the valve of a reservoir so that the air supply is initiated by said control device only when the external pressure increases.

We claim:

1. A show case for keeping and displaying objects, which has sides, a bottom, a cover and an interior therebetween, means for connecting said bottom, said sides and said cover which provide non-hermetic sealing therebetween, whereby said show case is exposed to variations in pressure and temperature in the interior thereof and in the environment and dust and harmful gases would enter the interior of said show case, means for preventing dust and gases from entering said interior of the show case, comprising air inlet means at least at the bottom or the cover and filtering means within said air inlet means for filtering and cleaning said air whereby when the pressure increases in the environment, filtered air flows into the interior of said show case.

2. The show case according to claim 1 which is provided with a first air vent at the bottom and said filtering means comprise a dust and gas protection filter mounted onto said air vent.

3. The show case according to claim 2, wherein said air vent is provided with a first valve allowing only air flow into the show case, and a second air vent is provided with an outlet valve for removing air from said show case when the pressure in the interior thereof decreases.

4. A show case for keeping and displaying objects comprising a base and a show case body having a cover, sides and an interior therebetween, means for connecting said base, said cover, said sides which provide non-hermetic sealing whereby said interior is exposed to variations in temperature and pressure in said interior and in the environment, pump means (10) connected to the interior of said show case body by means of air inlet means and forcibly ventilating said interior; filter means provided upstream or downstream of said pump means, whereby filtered air is introduced into said interior in an amount corresponding to the unfiltered air volumes which otherwise would flow per unit time into said show case due to an increased air pressure in the environment.

5. The show case according to claim 4, wherein said filter means comprise a dust and gas protection filter mounted on an air vent provided at the bottom of the show case.

6. The show case according to claim 4, wherein said show case body has an illumination box and said pump means is located in the base of the show case body in said illumination box.

7. The show case according to claim 6, wherein the atmospheric pressure in the environment of the show case body is measured by means of a pressure sensor, the show case body is provided with control means connected to said pump means and said pressure sensor is connected to said control means, whereby the pump means is activated only in response to an increase in pressure in the environment.

8. The show case according to claim 7 which is provided with refrigerator means for controlling the humidity of the air supplied to the interior of said show case.

9. The show case according to claim 6, wherein a pressure monitoring means is provided to detect the pressure in the interior of said show case and to control it by means of a control line connected to said pump means and the pressure means are provided with a device for signaling a sudden pressure drop.

10. The show case according to claim 9, wherein said device is an alarm system.

* * * * *